United States Patent [19]

Hayashi

[11] 4,416,134

[45] Nov. 22, 1983

[54] PROCESS FOR MANUFACTURING SEAMLESS METAL TUBES

[75] Inventor: Chihiro Hayashi, Amagasaki, Japan

[73] Assignee: Sumitomo Kinzoku Kogyo Kabushiki Kaisha, Osaka, Japan

[21] Appl. No.: 281,901

[22] Filed: Jul. 9, 1981

[30] Foreign Application Priority Data

Feb. 17, 1981 [JP] Japan ..... 56-22540

[51] Int. Cl.[3] ..... B21B 19/04

[52] U.S. Cl. ..... 72/68; 72/100; 72/368

[58] Field of Search ..... 72/68, 95, 97, 100, 72/368; 29/527.7

[56] References Cited

U.S. PATENT DOCUMENTS

| | | | |
|---|---|---|---|
| 347,703 | 12/1887 | Ritchie | 72/100 |
| 1,800,891 | 4/1931 | Kocks | 72/100 |
| 3,495,429 | 2/1970 | Muller | 72/100 |

*Primary Examiner*—Lowell A. Larson

*Attorney, Agent, or Firm*—Burns, Doane, Swecker and Mathis

[57] ABSTRACT

The present invention relates to the manufacture of seamless metal tubes by a cross-roll helical rolling process such as Mannesmann mandrel mill process or by a press piercing process such as Ugine Sejournet process. Shells being worked are subjected to outside-diameter reduction by means of a rotary mill having 3 or 4 rolls, without using internal tools such as plug and mandrel bar, so that wall eccentricity is significantly improved, which fact assured higher quality of finished product.

14 Claims, 14 Drawing Figures

FIG.4

Feed Angle 12°

| t/D | Cross Angle (γ) | | | | | |
|---|---|---|---|---|---|---|
| | +4° | +2° | 0° | −2° | −4° | −6° |
| 14 % | ⬠ | ⬠ | ○ | ○ | ○ | ○ |
| 12 % | ⬠ | ⬠ | ⬠ | ○ | ○ | ○ |
| 10 % | ⬠ | ⬠ | ⬠ | ⬠ | ○ | ○ |
| 8 % | ⬠ | ⬠ | ⬠ | ⬠ | ⬠ | ○ |
| 6 % | ⬠ | ⬠ | ⬠ | ⬠ | ⬠ | ⬠ |
| 4 % | ⬠ | ⬠ | ⬠ | ⬠ | ⬠ | ⬠ |

FIG.5

Feed Angle 8°

| t/D | Cross Angle (γ) | | | | | |
|---|---|---|---|---|---|---|
| | +4° | +2° | 0° | −2° | −4° | −6° |
| 14 % | ○ | ○ | ○ | ○ | ○ | ○ |
| 12 % | ⬠ | ⬠ | ○ | ○ | ○ | ○ |
| 10 % | ⬠ | ⬠ | ⬠ | ○ | ○ | ○ |
| 8 % | ⬠ | ⬠ | ⬠ | ⬠ | ○ | ○ |
| 6 % | ⬠ | ⬠ | ⬠ | ⬠ | ⬠ | ○ |
| 4 % | ⬠ | ⬠ | ⬠ | ⬠ | ⬠ | ⬠ |

FIG.6

Feed Angle 4°

| t/D | Cross Angle (γ) | | | | | |
|---|---|---|---|---|---|---|
| | +4° | +2° | 0° | −2° | −4° | −6° |
| 14 % | ○ | ○ | ○ | ○ | ○ | ○ |
| 12 % | ○ | ○ | ○ | ○ | ○ | ○ |
| 10 % | ⬠ | ⬠ | ○ | ○ | ○ | ○ |
| 8 % | ⬠ | ⬠ | ⬠ | ○ | ○ | ○ |
| 6 % | ⬠ | ⬠ | ⬠ | ⬠ | ○ | ○ |
| 4 % | ⬠ | ⬠ | ⬠ | ⬠ | ⬠ | ○ |

PROCESS FOR MANUFACTURING SEAMLESS METAL TUBES

BACKGROUND OF THE INVENTION (1) Fields of the Invention

The present invention relates to a process for manufacturing seamless metal tubes by a cross-roll helical rolling process such as Mannesmann mandrel mill process or by a press piercing process such as Ugine Sejournet process, and more particularly to a process which makes it possible to equalize wall thickness or to correct wall eccentricity.

(2) Description of the Prior Art

A rolling process to reduce outside diameter of hollow shells after piercing billets is known (Japanese Patent Publication Kokai No. 55-103208). The process has a purpose to decrease the number of sizer of billets to be provided to meet the specifications of various different finished products. A 2-roll type rotary mill is used for the process, but any internal tool such as plug or mandrel bar is not used. A phenomenon is found in said process without any internal tool that wall thickness becomes thick at every circumferential position and thickening phenomenon is more remarkable at thinner position as at thicker position when hollow shell has wall eccentricity. Therefore, it is a possibility to use this phenomenon for wall thickness equalization of shells, and actually the inventor of the present invention confirmed the effect. But any substantial effect was not obtained for tubes whose t/D (the ratio of wall thickness to outside diameter) is 5–15%. Because outside diameter reduction for said tubes with small t/D is 20% at the most, and the effect obtained from such reduction is as small as one obtained by improvement of conventional arts, and, therefore an introduction of said rotary mill does not pay for the purpose of wall thickness equalization or wall eccentricity correction.

On the other hand, it is found by this inventor's experiments that a 3-roll type rotary mill can substantially effectuate wall thickness equalization for shells with t/D of 5–15%, that is, a 3-roll type rotary mill is much more effective to wall thickness equalization as a 2-roll type rotary mill. However, the inventor found out a new problem, that is, on the bottom side of the shells rolled by the rotary mill, there is often caused pentagon formation as shown in FIGS. 9 and 10. The smaller the t/D, and the larger the ratio of outside diameter reduction, the more noticeable the phenomenon is. What is worse, as rolling speed is higher, pentagon formation extends over a larger length. Therefore, it is indispensable to solve this problem in order to apply said wall thickness equalization by the rotary mill for mass production line.

OBJECTS AND BRIEF SUMMARY OF THE INVENTION

The above in the technical background in which the present invention has been made.

It is therefore an object of the invention to provide a process for manufacturing seamless metal tubes which permits effective correction of wall eccentricity or equalization of wall thickness even if the ratio wall thickness to outside diameter (t/D) is as small as 5–15%.

It is another object of the invention to provide a process for manufacturing seamless metal tubes which prevents said pentagon formation.

It is a further object of the invention to provide a process for manufacturing seamless metal tubes which permits decreasing the number of sizes of billets to be prepared as stock for tube manufacturing.

The process for manufacturing metal seamless tubes of the present invention comprises a step of subjecting shell being worked to outside-diametre reduction by means of a cross roll-type rotary mill having 3 or 4 rolls arranged around a pass line, the axes of which rolls are inclined or inclinable so that the shaft ends on either side of the rolls stay close to or stay away from the pass line, said axes being inclined so as for the shaft ends on either side of the rolls to face to the peripheral direction on one and same side of the shell being worked, and without using internal sizing tools.

Other objects and novel features of the invention will be apparent from the following description taken in connection with the accompanying drawings.

BRIEF DESCRIPTION OF THE DRAWINGS

FIGS. 4 to 6, inclusive, are charts showing pentagon formation data based on experiments with the process of the invention;

DETAILED DESCRIPTION OF THE INVENTION

As described above, cross roll-type rotary mill having 3 or 4 rolls is used for outside diameter reduction without using internal tool.

Figure 1:
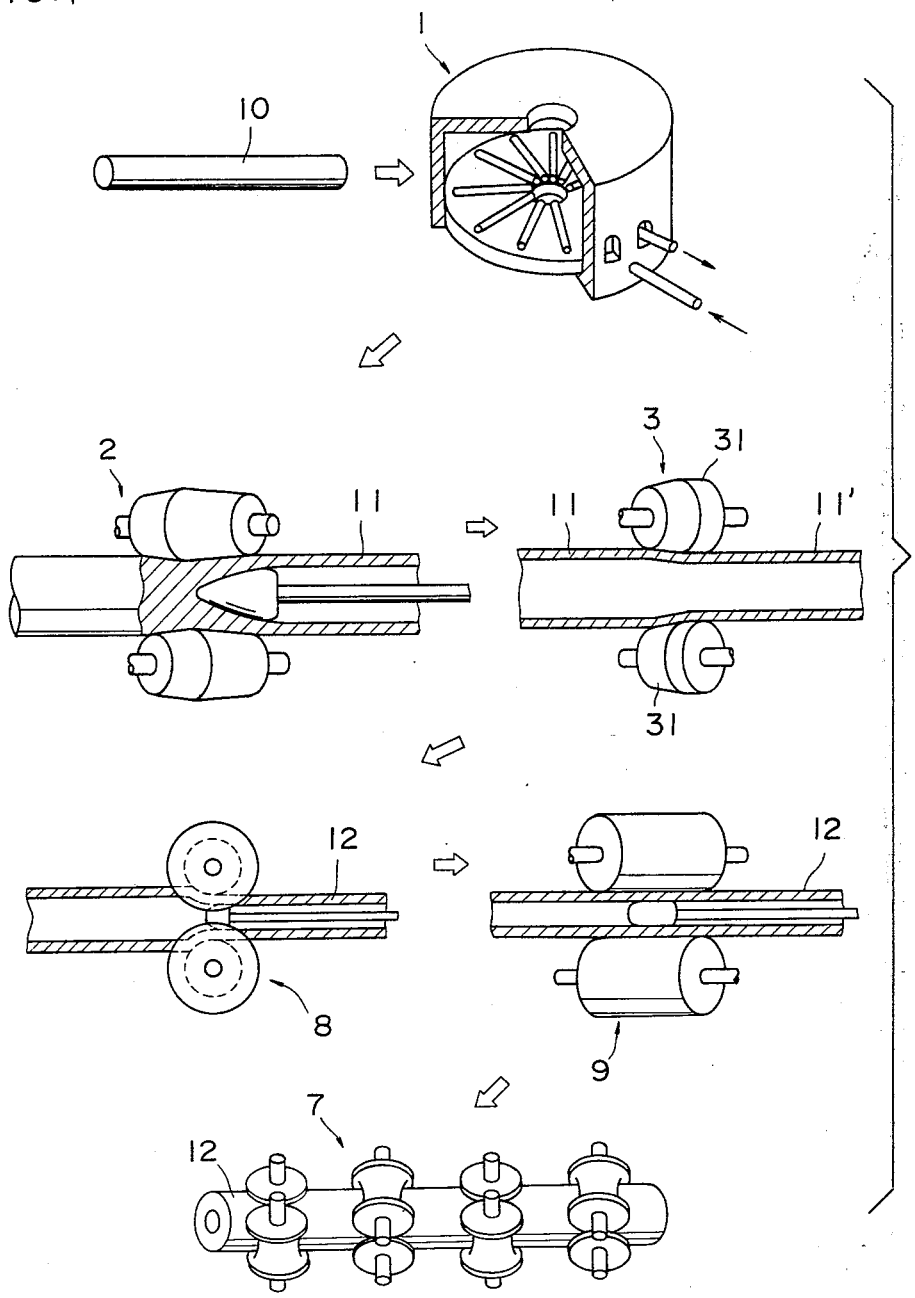
FIG. 1 is an illustrative representation showing the sequence of stages embodying still another aspect of the process of the invention.

An example of the process of the invention using a cross roll-type rotary mill having 3 rolls is explained hereinbelow. In FIG. 1 there is shown an example wherein a cross roll-type rotary mill is used in a Mannesmann plug mill line.

Round billet 10 is heated to 1200°–1250° C., for example, in a heating furnace 1 of rotary hearth type. The billet 10 is then pierced by a piercing mill 2 (Mannesmann piercer) into a hollow shell 11, which is then passed through a cross roll-type rotary mill 3 (hereinafter referred to as "wall-thickness equalizer") which is not provided with any internal sizing tool such as plug or mandrel bar. The wall-thickness equalizer 3, designed for correcting wall eccentricity of hollow shell 11, is essentially a rotary mill having 3 rolls 31 (only 2 rolls shown in FIG. 1) of a circular truncated cone type, each having a gorge portion at a location about half way in the direction of its axis, and has no internal sizing tool, as above mentioned. The rolls may be of barrel shape instead of truncated cone.

The hollow shell 11 is subjected, at the thickness equalizer 3, to outside-diameter reduction, during which operation it concurrently has its wall eccentricity corrected, and the so worked shell 11' is then fed to a plug mill 8, where it is subjected to elongation for wall thickness reduction, whereby it is made into a semi-finished tube 12 having a wall thickness substantially comparable to that of a finished tube. After subjected to reeling by means of a reeler 9, the semi-finished tube 9 is passed through a sizer 7 in which it is sized to finished size.

Figure 2A:
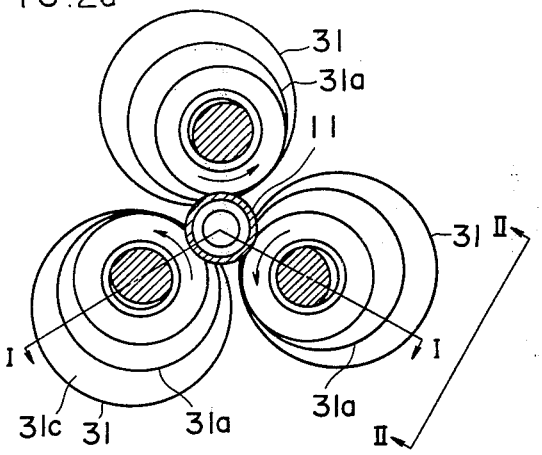
FIGS. 2 (*a*), 2 (*b*) and 2 (*c*) are views illustrating the roll arrangement in a wall-thickness equalizer having a positive cross angle (toe angle)
Figure 2B:
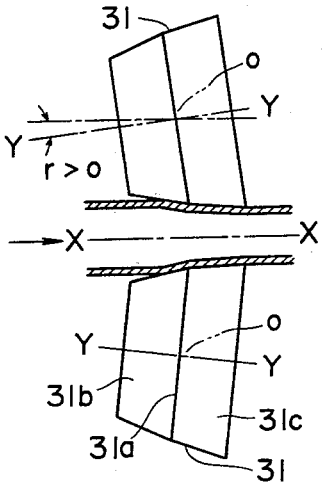
Figure 2C:
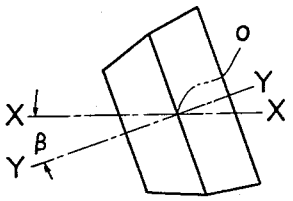

Concretely, some aspects of the configuration of the wall-thickness equalizer are shown in FIGS. 2 (*a*), 2 (*b*) and 2 (*c*), FIG. 2 (*a*) is a front elevation showing relative positions of rolls 31 which constitute a rolling mill as wall-thickness equalizer 3, as seen from the inlet side of the mill. FIG. 2 (*b*) is a sectional view taken along the lines I—I in FIG. 2 (*a*). FIG. 2 (*c*) is a side view taken on the line II—II in FIG. 2 (*a*). Each roll 31 has a gorge portion 31*a* about half way in the axial direction. The gorge 31*a* forms the boundary between the front portion (inlet side) and the rear portion (outlet side) of each roll. The front portion is gradually reduced in diameter toward the front shaft end, and the rear portion is gradually enlarged in diameter toward the rear shaft end. Thus, the roll is shaped like a circular truncated cone, and has an inlet surface 31*b* and an outlet surface 31*c*. The rolls 31 are arranged around a pass line X—X for shell 11 (pass line X—X corresponds to shell axis) in such a way that their centers, each represented by an intersection point 0 between an axis line Y—Y and a plane including the gorge 31*a* (said intersection point to be hereinafter referred to as roll center), are positioned at equal spacing on a plane crossing at right angle with the pass line X—X, with their respective inlet surface 31*b* side portions disposed on the inlet side in the direction of flow of shells 11. The axes Y—Y of the rolls 31, as seen from FIG. 2 (*b*), are inclined at an angle $\gamma$ (hereinafter referred to as cross angle or toe angle) relative to the pass line X—X so that their shaft ends on the same side, as viewed on a plane, that is, the front-side (inlet side) shaft ends approach toward the pass line X—X. The front shaft ends of the roll 31 face to the peripheral direction on one and same side (clockwise) of shell 11 as shown in side elevation in FIG. 2 (*a*), being inclined at feed angle $\beta$ as shown in FIG. 2 (*c*). The rolls 31 are connected to a drive source not shown, being driven to rotate in same direction. Shell 11 fed between the rolls 31 is moved in the axial direction while being rotated around the axis line. In other words, shell 11 is subjected to outside-diameter reduction while being screwed forward, whereby its wall eccentricity is corrected.

Figure 3A:
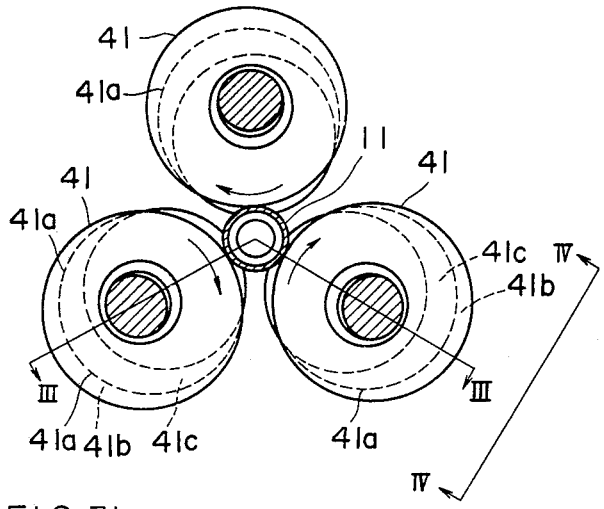
FIGS. 3 (*a*), 3 (*b*) and 3 (*c*) are views showing the roll arrangement in a wall-thickness equalizer having a negative cross angle.
Figure 3B:
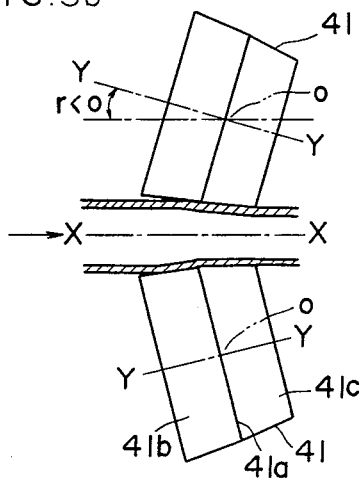
Figure 3C:
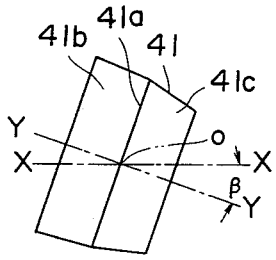

FIG. 3 shows another example of wall-thickness equalizer 3. In FIG. 3 (*a*) it is illustrated in front elevation as seen from the inlet side of the mill.

FIG. 3 (*b*) is a section taken along the lines III—III in FIG. 3 (*a*). FIG. 3 (*c*) is a side view taken on the line IV—IV in FIG. 3 (*a*). In the wall-thickness equalizer 3 shown, rolls 41 each has a gorge 41*a* about centrally in the axial direction. Each roll 41 consists of front and rear portions, with the gorge 41*a* between. The front portion is gradually expanded in diameter toward the front shaft end, and the rear portion is gradually reduced in diameter toward the rear shaft end. Each roll 41 is shaped like a circular truncated cone and has an inlet surface 41*b* and an outlet surface 41*c*. The rolls 41 are so arranged that the inlet surface (41*b*) side is positioned on the upper stream side of flow of shells II, with a cross angle set at $\gamma$ and a feed angle at $\beta$. The inclination in the peripheral direction, i.e., feed angle $\beta$ is so that the rear shaft end is in clockwise direction. Whereas the cross angle $\gamma$ for rolls 31 in FIGS. 2 (*a*)–2 (*c*), as can be clearly seen from FIG. 2 (*b*), is set in such a way that the inlet surface 31*b* of roll 31 is relatively close to the pass line X—X for shell 11, the cross angle $\gamma$ for the rolls 41 shown in FIGS. 3 (*a*)–3 (*c*), as is clear from FIG. 3 (*b*), is in reverse relation to that in FIG. 2 (*b*). The angle in the former case is hereinafter refered to as positive angle ($\gamma>0$), and the one in the latter case as negative angle ($\gamma<0$).

Experiments were made on a 3-roll cross roll-type rotary mill as the one shown in FIGS. 2 (*a*)–(*c*) and 3 (*a*)–(*c*) by employing same in subjecting shells to outside-diameter reduction, without using internal sizing tools such as mandrel, plug and the like. The results of these experiments are explained below.

For rolls in the rotary mill, truncated-cone-shaped rolls, each 180 mm in barrel length and 200 mm in diameter at gorge, were used, with feed angle designed in 3 different ways and cross angle in 6 different ways. Pentagon formation occurrence were examined with respect to various different combinations. Sample shells were used in 5 varieties in the outside diameter range of 80 mm–100 mm. Diameter reduction ratio was set at 20%, and roll speed at 200 r.p.m.

The experiment results are presented in FIGS. 4, 5 and 6, in which mark ○ denotes no pentagon formation and ⬠ denotes pentagon-shaped angulous deformation occurred.

Figure 9:
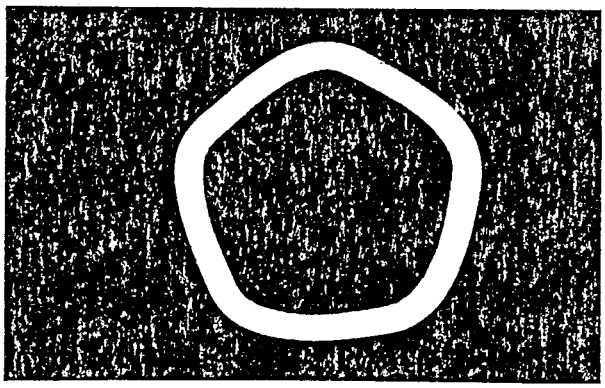
FIGS. 9 and 10 are photographic representations showing a pentagon-shaped angulous deformation seen with a seamless steel tube.
Figure 10:
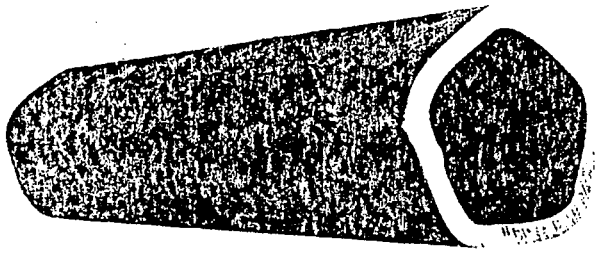

As can be seen from FIGS. 9, 10 and 11, cross angle $\gamma$-feed angle $\beta$ combinations in roll arrangement have considerable bearing upon pentagon formation control. For such control purpose, it is found most effective to have: ① feed angle $\beta$ set relatively small; ② cross angle $\gamma$ set small in the positive angle range; and ③ cross angle $\gamma$ set relatively large in absolute terms if given negative angle value. By setting feed angle $\beta$ relatively small is meant that screwing pitch in rolling is small and further that shell rotation speed in the roll-shell contact zone is increased. Thus, it can be said that smaller pitch of shell screwing and higher shell rotation speed are effective for the purpose of post-rolling pentagon formation control.

Setting positive cross angle $\gamma$ relatively small or setting negative cross angle $\gamma$ relatively large also means that shell screwing pitch is small and that shell rotation speed is increased. From the viewpoint of pentagon formation control, however, it is more effective to change cross angle $\gamma$ than to change feed angle $\beta$.

The fact that setting $\beta$ and $\gamma$ values relatively small (where $\gamma<0$, setting absolute value large) is effective as such is assumed to be attributable to the following reasons: As a result of these measures, screwing pitch becomes smaller and shell rotation speed is increased. Thus, various portions of the shell are subjected to diameter reducing action of the rolls more times. Moreover, time per turn of action becomes short. Consequently, wall thickness is effectively reduced in a smooth flow over the entire area.

Theoretically, it may be considered that above described feed and cross angle roll setting as preventive measures against pentagon formation is applicable to 2-roll rotary mill having no internal sizing tool and in which roll axes are inclined relative to the pass line, for the purpose of preventing angulous deformation which presents substantially triangular configuration as often observed typically in the case of diameter reducing for shells, t/D 5–15%. Where a 2-roll type rotary mill is used, however, expectable wall eccentricity correction effect is absolutely small; therefore, any effect sufficient to justify the cost of equipment may not be obtained.

Figure 7:
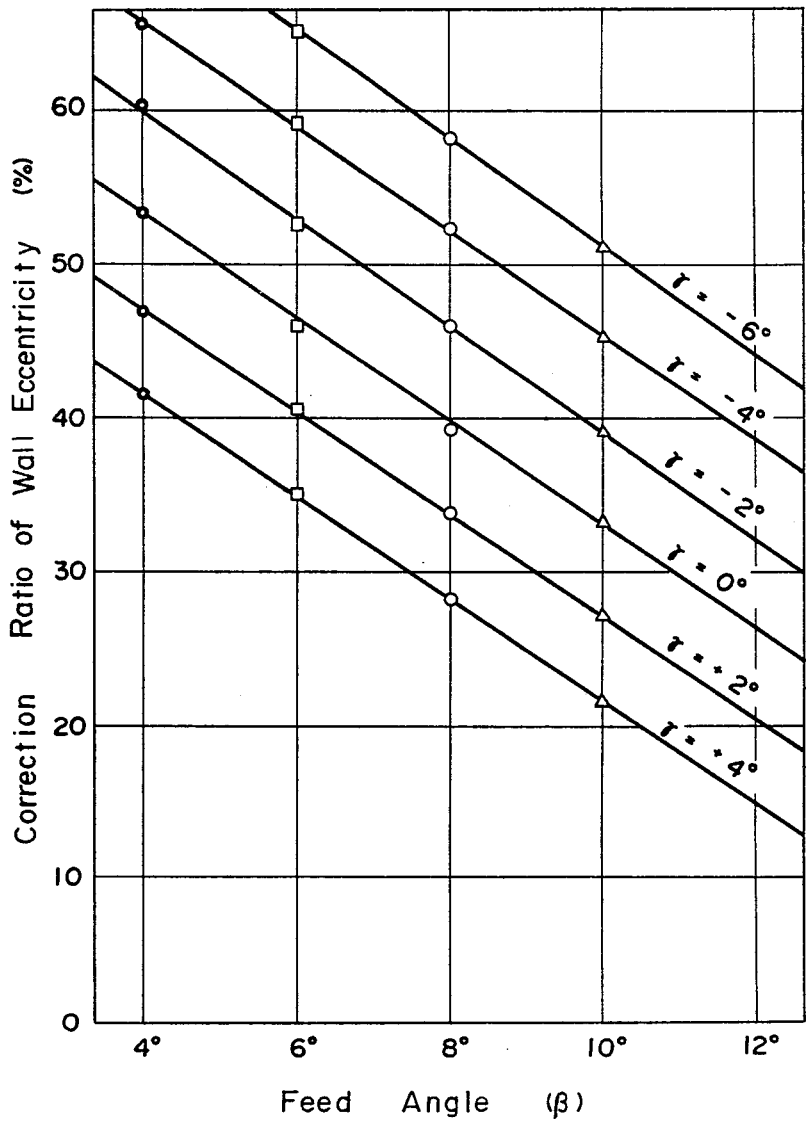
FIGS. 7 and 8 are graphs showing observations based on experiments with the process of the invention.

Referring to diameter reduction operation where a 3-roll cross roll-type rotary mill as above described is used as a wall-thickness equalizer, without using internal sizing tools, experiments were made on the relation between correction ratio of wall eccentricity and feed and cross angle settings $\beta$ and $\gamma$ for rolls. Results of the experiments are explained below. For the purpose of the cross roll-type rotary mill, rolls of the same specifications as used in the earlier mentioned experiments were used. Sample shells used were of the following descriptions: t/D 10%, 5 sizes within outer diameter range of 80 mm–100 mm; wall eccentricity ratios 10%, 20%, and 30%. The samples were subjected to rolling at rotation speed of 200 r.p.m. The results are graphically shown in FIG. 7, in which abscissa denotes feed angle $\beta$ and ordinate denotes correction ratio of wall eccentricity (%).

Correction ration of wall eccentricity referred to herein is expressed by the following formula:

$$\text{Correction ratio of wall eccentricity} = \frac{\text{Wall eccentricity ratio of shell} - \text{wall eccentricity ratio of product}}{\text{Wall eccentricity ratio of shell}} \times 100\%$$

As can be clearly noted from the graph, in order to improve correction ratio of wall eccentricity, it is most effective to have: ① feed angle $\beta$ set relatively small; ② cross angle $\gamma$ set small in the positive angle range; and ③ cross angle $\gamma$ set relatively large in absolute terms if given negative angle value. All this agrees with data on pentagon formation control as based on the experimental results presented in FIGS. 4, 5, and 6. Wall thickness is gradually transferred in the peripheral direction little by little over many times. That is, thickness transfer from thick portion to thin portion in the peripheral direction is selectively accomplished, and thus wall eccentricity is corrected.

If feed angle $\beta$ is set relatively small, with cross angle $\gamma$ set, on the negative angle side, relatively large in absolute terms, correction ratio of wall eccentricity of more than 60% can be obtained. This stands in a striking contrast with the fact that where a 2-roll type rotary mill in which roll axes are inclined relative to the pass line but do not cross with it is employed as a thickness equalizer, a correction ratio obtainable may be at most 20% or so. The fact that a correction ratio of as high as 60% is obtainable means that an eccentricity ratio of 30% with a shell can be reduced to 12%; that in the case of a shell with an eccentricity ratio of 20%, the ratio can be reduced to 8%; and if the eccentricity ratio is 10%, it can be reduced to 4%.

Figure 8:
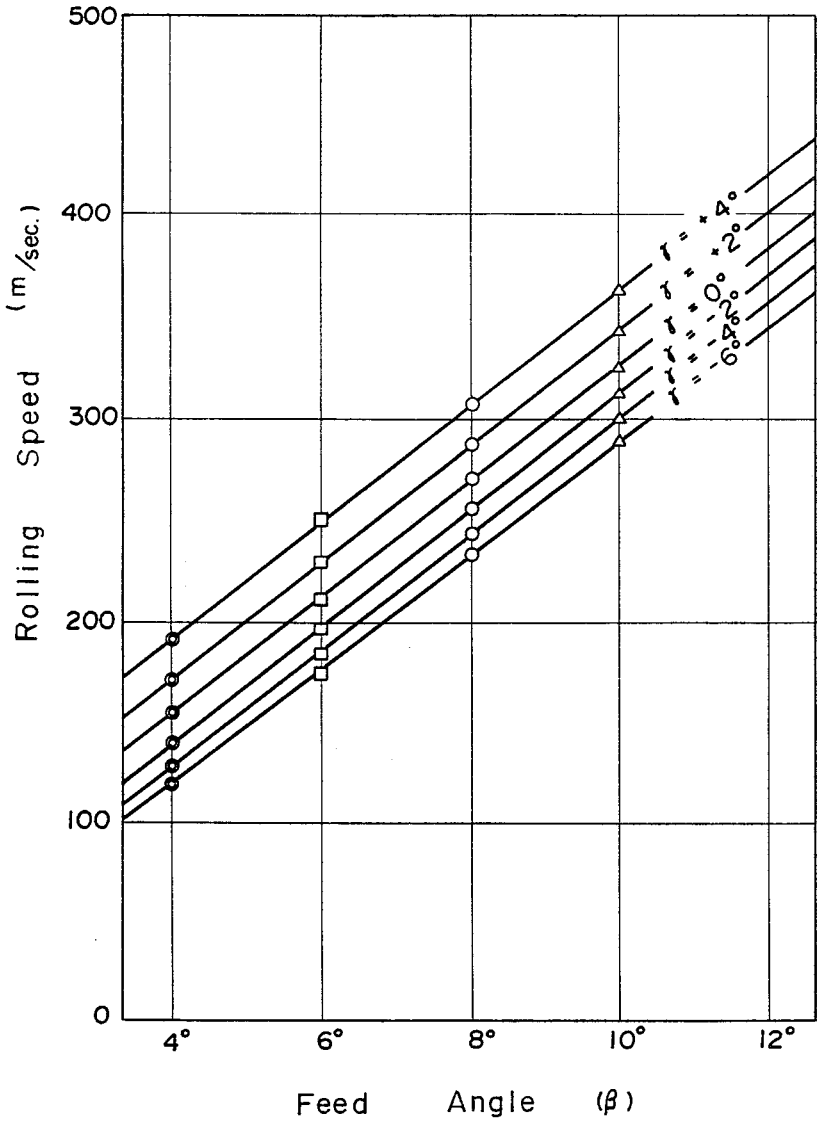

Next, where diameter reduction operation is carried out by means of above said 3-roll cross roll-type rotary mill and without employing interanal sizing tools, the relations between rolling speed and feed and cross angle settings $\beta$ and $\gamma$ for rolls will be explained on the basis of experimental data. Used rolls were of the same dimensions as earlier mentioned. Samples shells of the following description were used: t/D 10%, outside diameter 90 mm, wall thickness 9.0 mm. The shell were subjected to outside-diameter reduction under these conditions: reduction ratio 20%, rotation velocity 200 r.p.m. The results are graphed in FIG. 8, wherein the abscissa denotes feed angle $\beta$ and the ordinate denotes rolling speed.

As is clear from the graph, in order to increase rolling speed, it is desirable to have: ① feed angle $\beta$ set relatively large; ② cross angle $\gamma$ set relatively small in absolute terms, if it is given a negative value; and ③ cross angle $\gamma$, if on the positive side, set relatively large in absolute terms.

It is noted that the above described conditions for increasing rolling speed are in complete disagreement with the earlier mentioned conditions for preventing pentagon formation or for improving correction ratio of wall eccentricity. This is quite natural since the conditions for the latter purposes are largely related with the matter of reducing the screwing pitch for shells. If emphasis is placed on metal tube quality only, rolling speed may well be sacrificed. As a matter of practice, however, when incorporating a 3-roll cross roll-type rotary mill, as a thickness equalizer, into a manufacturing process for seamless metal tubes, the matter of efficiency balance is of great importance, especially where a high-productivity metal tube making process is used. The presence of a significant unbalance between such rotary mill and existing rolling mills at adjacent stage, for example, piercer and plug mill, may often make such introduction impracticable. Therefore, in setting up a 3-roll cross roll-type rotary mill as above described, prudent consideration must be given to productivity as well as pentagon formation control and wall eccentricity correction so that setup conditions may be determined from a standpoint of overall requirements.

By way of example, preferred setup conditions are presented below.

(i) Basically, roll setup conditions for cross roll-type rotary mill should be such that feed angle $\beta$ is set as small as feasible, with cross angle $\gamma$ set as large as possible in absolute terms on the negative angle side. Decrease in productivity due to use of smaller feed angle $\beta$ may be prevented preferably by increasing rotation speed of rolls as much as possible.

(ii) It is to be noted, however, that an excessive increase of rotation speed of rolls may often be a cause of trouble and undesirable from the standpoint of safety, and further that it may more or less have a negative effect on pentagon formation control and wall eccentricity correction. Therefore, when setting cross angle on the positive angle side, it is desirable to set feed angle $\beta$ at as small a value as possible and to compensate any decrease in productivity resulting therefrom by setting cross angle relatively large. It is also desirable that when setting cross angle $\gamma$ on the negative angle side, as large avalue in absolute terms as feasible should be used and that any decrease in productivity due thereto should be compensated by setting feed angle as large as possible.

(iii) If there is no problem of productivity balance with thickness equalizer in tube manufacturing process, it is desirable that feed angle $\beta$ is set as small as possible, with cross angle $\gamma$ set on the negative angle side as large as possible in absolute terms, whereby greater pentagon formation control and correction effect of wall eccentricity may be obtained.

The process described above is not only applicable to Mannesmann mandrel line, but also is it applicable for the purpose of correcting spiral wall eccentricity occurred in Mannesmann mandrel mill, Mannesmann multi-stand pipe mill, Mannesmann assel mill and Mannesmann pilger mill lines and/or for the purpose of correcting parallel eccentricity developed in Ugine-Sejournet extrusion and Ehrhardt push bench reducing lines. Naturally, it is applicable to a tube manufacturing line employing a press piercer instead of Mannesmann piercer.

For the purpose of applying the process of the invention to various lines referred to above, the following layouts are recommended.

(1) In Mannesmann mandrel mill line (heating furnace→Mannesmann piercer→mandrel mill→reheating furnace→stretch reducer), a wall-thickness equalizer is provided preferably on the outlet side of Mannesmann piercer or, depending upon conditions, on the outlet side of mandrel mill for correcting wall eccentricity. In this case, wall eccentricity correction or wall thickness equalization may be effected with shells in a thin wall range such as t/D 5–15%.

(2) In Mannesmann plug mill line (heating furnace→Mannesmann piercer→rotary elongator→plug mill→reeler→sizer), wall eccentricity correcting or wall thickness equalizing operation is carried out desirably on the outlet side of mannesmann piercer or, depending upon conditions, on the outlet side of plug mill, In the case where piercing ratio at Mannesmann piercer is substantially large, rotary elongator may be omitted.

(3) In mannesmann multi-stand pipe mill line (heating furnace→Mannesmann piercer→rotary elongator→multi-stand pipe mill→reheating furnace→sizer), wall eccentricity correcting or wall thickness equalizing is carried out desirably on the outlet side of piercer or of rotary elongator or, depending upon conditions, on outlet side of multi-stand pipe mill.

(4) In Mannesmann assel mill line (heating furnace→Mannesmann piercer→assel mill→reheating furnace→sizer→rotary sizer), eccentricity correction or wall thickness equalization is carried out preferably on the outlet side of Mannesmann piercer or, depending upon conditions, on the outlet side of assel mill. Where piercing ratio at Mannesmann piercer is substantially large, assel mill may be omitted.

(5) In Mannesmann pilger mill line (heating furnace→Mannesmann piercer→pilger mill→sizer), eccentricity correction or wall thickness equalization is carried out preferably on outlet side of Mannesmann piercer or, depending upon conditions, on the outlet side of pilger mill.

(6) In Ugine-Sejournet extrusion line (heating furnace→vertical press→horizontal press), wall eccentricity correction or wall eccentricity equalization operation is carried out preferably on the outlet side of the vertical press, but depending upon conditions, such operation may be carried out on the outlet side of horizontal press.

(7) In Ehrhardt push bench reducing line (heating furnace→Ehrhardt vertical press→push bench), wall eccentricity correction or wall thickness equalization is carried out preferably on the outlet side of Ehrhardt vertical press, but may be carried out on the outlet side of push bench depending upon conditions.

It is noted that above described examples relate to cases where a 3-roll cross roll-type rotary mill is employed as a thickness equalizer. However, the process of the present invention is also applicable where a 4-roll cross roll-type rotary mill is used. In this case, greater correction effect may be obtained. This can be readily anticipated from the fact that rolling pressure is distributed over 4 rolls. According to the inventors' estimation, where $\gamma$ is on the negative angle side and $\beta$ is relatively small, a correction ratio of wall eccentricity of 90% or more may be attained. From the viewpoint of construction, a 4-roll cross roll-type rotary mill can be obtained only by increasing the number of rolls arranged around pass line from above said three to four. However, 4-rolls make the arrangement complicated, and therefore, it is desirable that 2 of the 4 rolls employed as drive rolls and the other 2 as idle rolls.

As described above, the process of the invention employs a 3-roll or 4-roll cross-type rotary mill as a wall-thickness equalizer; and by subjecting shells to wall-diameter reduction and without using internal sizing tools such as mandrel bar and plug, extremely good correction effect can be obtained without any deformation such as pentagon formation caused to shells, and without rolling speed being sacrificed. In addition, by effecting wall eccentricity correction with respect to shells, section deviation of finished product can be notably decreased, which means improved product quality. Further, as a primary effect of diameter reduction, the number of sizes of billets as materials for tube making can be reduced.

What is claimed is:

1. A process for manufacturing seamless metal tubes which comprises the steps of piercing a billet in a piercing mill to form a hollow shell having a wall thickness to outer diameter ratio of 5 to 15% and thereafter reducing the outer diameter of the said shell by rolling to equalize the wall thickness by means of a cross-roll type rotary mill having 3 or 4 rolls arranged around a pass line without any internal tools, the axes of said rolls being inclined so that the shaft ends on the shell-entry side of the rolls are at a cross angle $\gamma$ from the pass line, said axes being inclined at a feed angle $\beta$ so as that the shaft ends on either side of the rolls face the peripheral direction on the same side of the shell being worked, said cross angle $\gamma$ being negative and said feed angle $\beta$ being as small as possible.

2. The process of claim 1 wherein the said shell is subjected to a rotary elongating step prior to the outer diameter reducing step.

3. The process of claim 1 wherein the said billet is subjected to a rotary elongating step after the outer diameter reducing step.

4. The process of claim 2, wherein the rotary elongating step is conducted in a mandrel mill.

5. The process of claim 3, wherein the rotary elongating step is conducted in a mandrel mill.

6. The process of claim 2, wherein the rotary elongating step is conducted in a pilger mill.

7. The process of claim 3, wherein the rotary elongating step is conducted in a pilger mill.

8. The process of claim 2, wherein a plug mill is employed for the rotary elongating step.

9. The process of claim 3, wherein a plug mill is employed for the rotary elongating step.

10. The process of claim 2, wherein a multi-stand pipe mill is employed for the rotary elongating step.

11. The process of claim 3, wherein a multi-stand pipe mill is employed for the rotary elongating step.

12. The process of claim 1, wherein the pierced shell is subjected to the step of hot extrusion after said piercing step and prior to the outer-diameter reducing step.

13. The process of claim 1, wherein the pierced shell is subjected to the step of hot punching after said piercing step and prior to the outer-diameter reducing step.

14. The process of claim 1, wherein the pierced shell is subjected to the step of hot punching after the outer-diameter reducing step.

* * * * *